US010451065B2

(12) United States Patent
Thuresson

(10) Patent No.: US 10,451,065 B2
(45) Date of Patent: Oct. 22, 2019

(54) PAIR OF CO-OPERATING SCREW ROTORS

(71) Applicant: Svenska Rotor Maskiner AB, Stockholm (SE)

(72) Inventor: Erik Thuresson, Älta (SE)

(73) Assignee: Svenska Rotor Maskiner AB (SE)

( * ) Notice: Subject to any disclaimer, the term of this patent is extended or adjusted under 35 U.S.C. 154(b) by 184 days.

(21) Appl. No.: 15/503,071

(22) PCT Filed: Jun. 26, 2014

(86) PCT No.: PCT/EP2014/063553
§ 371 (c)(1),
(2) Date: Feb. 10, 2017

(87) PCT Pub. No.: WO2015/197123
PCT Pub. Date: Dec. 30, 2015

(65) Prior Publication Data

US 2017/0227009 A1 Aug. 10, 2017

(51) Int. Cl.
*F04C 18/00* (2006.01)
*F04C 2/00* (2006.01)
(Continued)

(52) U.S. Cl.
CPC ..... *F04C 18/084* (2013.01); *F01C 1/084* (2013.01); *F04C 18/16* (2013.01); *F04C 2240/20* (2013.01); *F04C 2250/20* (2013.01)

(58) Field of Classification Search
CPC .... F04C 18/084; F04C 18/16; F04C 2240/20; F04C 2250/20; F04C 2/16; F01C 1/084; F01C 1/16
(Continued)

(56) References Cited

U.S. PATENT DOCUMENTS 3,414,189 A * 12/1968 Persson ..... F04C 18/084 418/201.3
3,423,017 A * 1/1969 Schibbye ..... F04C 18/084 418/201.3
(Continued)

FOREIGN PATENT DOCUMENTS

CN 1434214 A 8/2003
CN 1690427 A 11/2005
(Continued)

OTHER PUBLICATIONS

Chinese Office Action and Translation dated Jun. 5, 2018 for Application No. 201480080016.6 filed on Jun. 26, 2014, consisting of 10-pages.
(Continued)

*Primary Examiner* — Theresa Trieu
(74) *Attorney, Agent, or Firm* — Christopher & Weisberg, P.A.

(57) ABSTRACT

A pair of co-operating screw rotors including a male rotor and a female rotor. The male rotor and the female rotor have helically extending lobes and intermediate grooves configured to intermesh with one another. Each groove of the female rotor has a first flank including at least three concave sections. A first section includes or is disposed immediately adjacent the radially innermost point of the groove. A second section is shaped as a circular arc with a radius having its center located outside the pitch circle. A third section is shaped as a circular arc with a radius having its center located outside the pitch circle. The radius of the third section is greater than the radius of the second section, which is greater than the radial distance between a pitch circle of the female rotor and the radially innermost point of the groove.

20 Claims, 4 Drawing Sheets

(51) Int. Cl.
*F04C 18/08* (2006.01)
*F01C 1/08* (2006.01)
*F04C 18/16* (2006.01)

(58) Field of Classification Search
USPC ..... 418/201.1–201.3
See application file for complete search history.

(56) References Cited

U.S. PATENT DOCUMENTS

| | | | | |
|---|---|---|---|---|
| 3,787,154 A | | 1/1974 | Edstrom | |
| 4,140,445 A | | 2/1979 | Schibbye | |
| 4,350,480 A | * | 9/1982 | Bammert | F04C 18/084 418/201.3 |
| 4,435,139 A | * | 3/1984 | Astberg | F04C 18/084 418/201.3 |
| 4,576,558 A | | 3/1986 | Tanaka et al. | |
| 4,679,996 A | * | 7/1987 | Tanaka | F04C 18/084 418/201.3 |
| 5,947,713 A | * | 9/1999 | Ohman | F04C 18/084 418/201.3 |
| 6,000,920 A | * | 12/1999 | Yoshimura | F04C 18/084 418/201.3 |
| 2004/0228753 A1 | * | 11/2004 | Tang | F04C 18/084 418/201.3 |

FOREIGN PATENT DOCUMENTS

| | | |
|---|---|---|
| DE | 2508435 A1 | 9/1975 |
| EP | 0 158 514 A2 | 10/1985 |
| JP | S4926812 | 3/1974 |
| JP | 5525578 | 2/1980 |
| JP | S61268891 | 11/1986 |
| RU | 2126312 C1 | 2/1999 |
| SU | 1440356 A3 | 11/1988 |

OTHER PUBLICATIONS

Japanese Office Action and Translation dated May 9, 2018 for Application No. 2016-574961, consisting of 6-pages.
International Search Report and Written Opinion dated Jul. 31, 2014 for International Application Serial No. PCT/EP2014/063553, International Filing Date—Jun. 26, 2014 consisting of 9-pages.
Russian Official Action dated Feb. 8, 2018 for Application No. 2017102329/06(004090) filed on Jun. 26, 2014, consisting of 11-pages.
Japanese Office Action and English Translation dated Jan. 9, 2019 for Japanese Application No. 2016-574961, consisting of 9-pages.

* cited by examiner

PAIR OF CO-OPERATING SCREW ROTORS

CROSS-REFERENCE TO RELATED APPLICATIONS

This application is a Submission Under 35 U.S.C. § 371 for U.S. National Stage Patent Application of International Application Number: PCT/EP2014/063553, filed Jun. 26, 2014 entitled "PAIR OF CO-OPERATING SCREW ROTORS," the entirety of which is incorporated herein by reference.

TECHNICAL FIELD OF THE INVENTION

The invention relates to the field of screw rotors for positive displacement machines, such as a rotary screw compressor.

TECHNICAL BACKGROUND

Screw rotors for rotary screw machines are known in the art. Each rotor has helically extending lobes and intermediate grooves, through which the rotors intermesh, one rotor is a male rotor with each lobe in a section perpendicular to the rotor axes having a leading lobe flank and a trailing lobe flank, both being substantially convex. The other rotor is a female rotor with each lobe in said section having a leading and a trailing lobe flank, both being substantially concave. Each lobe of the male and female rotor has an asymmetric profile in said section.

In a rotary screw machine of the kind for which the rotors of the invention are intended, a compressible medium is compressed or expanded by intermeshing two rotors in a working space sealingly surrounding the pair of rotors which has the shape of two intersecting circular cylinders.

Decisive to the function and the efficiency of such a machine is the shape of its rotors, more precisely the shape of the flanks of the rotor lobes.

Normally, in a rotary screw compressor at work only one of the rotors is driving and transmits torque to the other one, the driven rotor. Usually a liquid is injected such as oil or water into the working space of the machine, which liquid forms a film on the flanks of the lobes for lubricating, cooling and sealing purposes. The lobes co-operate by intermeshing and are shaped to transmit torque between the rotors and to seal working chambers in the working space of the machine. An important aspect when designing the profiles of the lobes therefore is to attain a contact band between the rotors that in this respect is optimal. The contact band should be of sufficient size for the contact pressure which the material and the liquid film are exposed to. When designing the rotor profiles one has to take the total length of the contact band or the sealing line into consideration as well as other general aspects such as the size of the blow-hole, the contact forces, the volumetric capacity, thermal expansion, generation of vibrations and demands relating to the manufacture. There are also some mathematical limitations for the profiles. For some compressors, certain aspects are more important than others and for other compressors there might be reasons to give priority to other aspects. An optimal profile usually represents a compromise between different requirements related to these aspects, the compromise being dependent on which of these are the most important in the actual case.

Due to the decisive importance of the shape of the rotor profiles in a rotary screw machine and due to the complex weighting between the aspects that have to be considered there are a large number of granted patents focusing on the profiles, all since Lysholm during the thirties presented and got a patent for the first rotary screw compressor of this kind that could be used in practice.

There are many ways in patent literature in which the rotor profiles are defined, depending on which problem(s) the patent relates to and due to the complicated shape of these profiles. The profiles are thus defined as a family of characteristics, a combination of such, by some important parameters, by ranges for certain features of the profile, by expressions implicitly defining the profile or in another way. Furthermore the profiles can be divided into different categories according to various criteria such as symmetric or asymmetric profiles and such as point generated or line generated.

It is understood that point generation refers to that a single point on either of the rotors generate a longer part on the other of the two rotors, and that line generation refers to that one single point on one rotor corresponds only to one single point on the other of the two rotors. Point generation may be disadvantageous since a manufacturing error or wear at the generation point on one of the rotors will open a leakage along the entire generated part on the other of the rotors. Line generation does not suffer from this problem, but may on the other increase drag losses and friction.

U.S. Pat. No. 3,423,017 discloses an asymmetric profile, the so called "A-profile", which is line generated on the leading flank and point generated on the trailing high pressure flank. The blow hole is substantially reduced compared to earlier profiles due to the use of reciprocal point generation on the high pressure flank. The torque transmission characteristics are furthermore advantageous. One problem however is that this profile is difficult and/or expensive to manufacture in manufacturing tools, due to its relatively sharp corners and closed shape.

U.S. Pat. No. 4,435,139 discloses another asymmetric profile, the so called "D-profile", which is easier to manufacture, but on the other provides less advantageous torque transmission characteristics and high surface pressure at the contact band.

U.S. Pat. No. 5,947,713 discloses yet another profile, the so called "G-profile", which aims to solve the problem of high surface pressure by providing the two rotors with arc segments of corresponding radius. This profile is however also quite closed in character and may therefore be difficult and/or expensive to manufacture.

SUMMARY OF THE INVENTION

It is an object of the present invention to provide a pair of co-operating rotors for a rotary screw machine with a low surface pressure at the contact band between the rotors while being relatively inexpensive to manufacture.

This and other objects are achieved according to the present invention by providing a pair of co-operating rotors having the features in the independent claim. Preferred embodiments are defined in the dependent claims.

According to the invention, there is provided a pair of co-operating screw rotors, comprising a male rotor and a female rotor. The male rotor has helically extending lobes and intermediate grooves, and the female rotor has helically extending lobes and intermediate grooves which are configured to intermesh with the helically extending lobes and intermediate grooves of the male rotor. The female rotor has a pitch radius defining a pitch circle. Each groove of the female rotor has a first flank comprising at least three concave sections. A first section comprises the radially innermost point of said groove. A second section is shaped as a circular arc with a radius having its center located outside the pitch circle. A third section is shaped as a circular arc with a radius having its center located outside the pitch circle. The radius of the third section is greater than the radius of the second section, which is greater than the radial distance between the pitch circle and the radially innermost point of said groove.

Put differently, each groove of the female rotor may, in a predetermined section, have a first flank which may be substantially concave, where the predetermined section is perpendicular to the rotational axis of the female rotor, where the first flank has at least three concave or substantially concave sections. The first section comprises, or is disposed immediately adjacent, the radially innermost point of said groove. A second section may be described as a circular arc segment having a center of curvature and a radius of curvature, where the center of curvature is outside the pitch circle of the female rotor; and a third section may be described as a circular arc segment having a center of curvature and a radius of curvature, where the center of curvature is outside the pitch circle of the female rotor. The radius of curvature of the third section is greater than the radius of curvature of the second section, which is greater than the radial distance between the pitch circle and the radially innermost point of said groove.

The present invention is based on the insight that a convex-concave contact between the rotors is advantageous with respect to surface pressure and torque transmission characteristics, and is furthermore based on the insight that such convex-concave contact may be achieved in a pair of co-operating screw rotors which are relatively inexpensive to manufacture by providing a first flank of the female rotor with at least three concave sections, where a radius of the third section is greater than a radius of the second section, which is greater than the radial distance between the pitch circle and the radially innermost point of said groove. The at least three concave sections having such geometrical properties result in a more open shape of the female rotor profile, which makes the rotor easier to manufacture, while achieving the desired convex-concave contact between the male and female rotors.

It is understood that each groove of the female rotor also comprises a second flank opposite the first flank. The second flank is not defined by the present invention and may be of a known geometry, for example of the type used in the A-profile, D-profile or G-profile discussed in the above background section. Thus, depending on the choice of profile, the second flank of the female rotor may be line generated or point generated by the male rotor.

It is understood that the above described first flank of the female rotor is the leading flank of the female rotor in the case of male drive. In the case of female drive, the first flank is the trailing flank.

In a first embodiment the first section is shaped as a circular arc with a radius having its center located on the pitch circle. The radius of the first section may furthermore correspond to the radial distance between the pitch circle and the radially innermost point of the groove. The center of the first section may furthermore be defined by the crossing of the pitch circle and a straight line traversing the center of the rotor and the radially innermost point of the groove. In an embodiment, each lobe of the male rotor has a first lobe flank comprising one or at least one substantially convex section which is generated at least partly by one or more of the at least three concave sections of the female rotor. The one or at least one substantially convex section may be line generated by the female rotor.

In a second embodiment, each lobe of the male rotor has a first lobe flank comprising a convex section which is shaped as a circular arc with a radius having its center located on or inside the pitch circle of the male rotor. Put differently, each lobe of the male rotor in a predetermined section may have a first lobe flank which may be substantially convex, where the predetermined section is perpendicular to the rotational axis of the male rotor, where the first lobe flank comprises a convex section which is a circular arc segment having a center of curvature and a radius of curvature, where the center of curvature is on or inside the pitch circle of the male rotor. The first section of the female rotor is generated by the convex section of the male rotor. In other words, the first section of the female rotor is the envelope of the convex section of the male rotor. The first section of the female rotor may be line generated. Each first lobe flank of the male rotor may comprise one or more additional convex section(s) which may be generated by the second and/or third section of the first flank of the female rotor. The one or more additional convex section may be line generated by the second and/or third section of the first flank of the female rotor.

In another embodiment, the second section is shaped as a circular arc with a radius having its center located on a straight line extending radially from an end point of the first section along the normal direction of the first section. In other words, the radius has its center located on a straight line extending along a limiting line of the first section. In the embodiment where the first section is shaped as a circular arc with a radius having its center located on the pitch circle, the straight line extends from the end point of the first section through the cross section of the pitch circle and a straight line extending from the center of the rotor through the innermost radially innermost point of the groove.

In yet another embodiment, the third section is shaped as a circular arc with a radius having its center located on a straight line extending radially from an end point of the second section along the normal direction of the second section. In other words, the circular arc has its center located on a straight line extending along a limiting line of the second section.

In yet another embodiment, the first, second and third sections are formed immediately adjacent to each other. In other words, end or limiting points of the first and second sections coincide, and end or limiting points of the second and third sections coincide.

In yet another embodiment, the sections may be consecutively disposed. In other words, the first section comprises, or is disposed immediately adjacent, the radially innermost point of said groove, the second section is disposed adjacent the first section, and the third section is disposed adjacent the second section, such that the second section is disposed between the first and second sections.

In yet another embodiment, the radius of the second section is 1.25 to 1.75 times the radial distance between the pitch circle and the radially innermost point of the groove, and the radius of the third section is 2 to 3 times the radial distance between the pitch circle and the radially innermost point of the groove. In an embodiment where the first section is shaped as a circular arc with a radius having its center located on the pitch circle, the radius of the second section is 1.25 to 1.75 times the radius of the first section, and the radius of the third section is 2 to 3 times the radius of the first section.

In yet another embodiment, each groove of the female rotor has a second flank comprising a concave or substantially concave section, and each lobe of the male rotor has a second lobe flank comprising a convex or substantially convex section which is generated at least partly by the concave or substantially concave section of the female rotor. In yet another embodiment, each groove of the male rotor has a second flank comprising a convex or substantially convex section, and each lobe of the female rotor has a second lobe flank comprising a concave or substantially concave section which is generated at least partly by the convex or substantially convex section of the male rotor. It is understood that these two embodiments may be combined, i.e. that a first convex or substantially convex section of the second lobe flank of the male rotor is generated by a first concave or substantially concave section of the second flank of the female rotor and that a second concave or substantially concave section of the second flank of the female rotor is generated by a first convex or substantially convex section of the second lobe flank of the male rotor. It is understood that the term second flank or second lobe flank refers to a flank or lobe flank which is oppositely directed to the first flank or lobe flank as seen in the rotational direction of the rotors.

BRIEF DESCRIPTION OF THE DRAWINGS

These and other aspects of the present invention will now be described in more detail, with reference to the appended drawings showing currently preferred embodiment(s) of the invention, wherein.

DETAILED DESCRIPTION OF PREFERRED EMBODIMENTS

In the following description, known screw rotors according to the prior art and also embodiments of the present invention are described.

Figure 1:
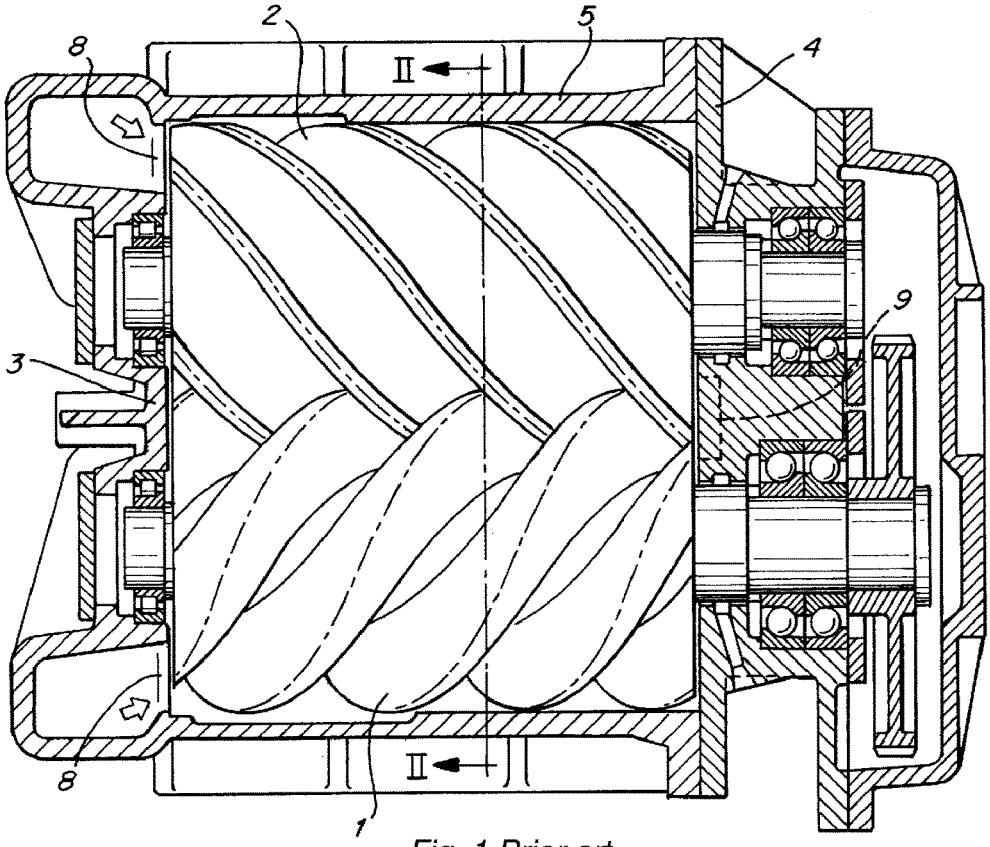
Fig. 1 Prior art
FIGS. 1-3 illustrate a rotary screw compressor according to generally known technique, and the function principle is explained in relation thereto.
Figure 2:
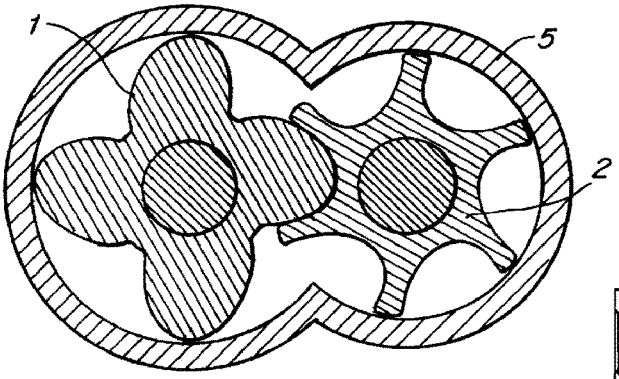
Fig. 2 Prior art
Figure 3:
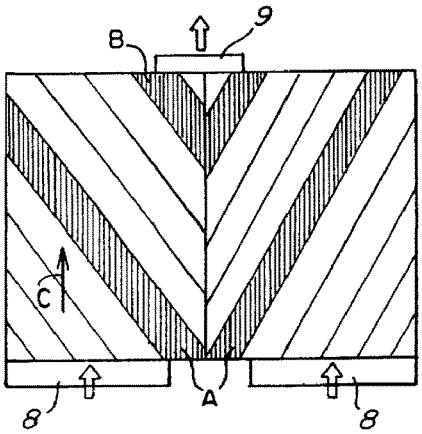
Fig. 3 Prior art

FIGS. 1-3 illustrate a rotary screw compressor according to generally known technique. The compressor includes a pair of meshing screw rotors 1, 2 operating in a working space limited by two end walls 3, 4 and a barrel wall 5 extending between these, which barrel wall 5 has an internal shape substantially corresponding to that of two intersecting cylinders as can be seen in FIG. 2.

Each rotor 1, 2 has a plurality of lobes, and intermediate grooves extending helically along the entire rotor. One rotor 1 is of the male rotor type with the major part of each lobe located outside the pitch circle and the other rotor is of the female rotor type with the major part of each lobe located inside the pitch circle. The female rotor normally has more lobes than the male rotor 1, and a common lobe combination is 4+6. Low pressure air or gas is admitted into the working space of the compressor through an inlet port 8, is then compressed in the chevron-shaped working chambers formed between the rotors and the walls of the working space. Each chamber travels to the right in FIG. 1 as the rotors rotate, and the volume of a working chamber will continuously decrease during the later stage of its cycle after communication with the inlet port 8 has been cut off. Thereby the air or gas will be compressed, and the compressed air or gas leaves the compressor through an outlet port 9. The internal pressure ratio will be determined by the internal volume ratio, i.e. the relation between the volume of a working chamber immediately after its communication with the inlet port 8 has been cut off and the volume of a working chamber when it starts to communicate with the outlet port 9.

The compression cycle is schematically illustrated in FIG. 3, which shows the barrel wall developed in a plane, the vertical lines representing the two cusps, i.e. the lines along which the cylinders forming the working space intersect. The inclined lines represent the sealing lines established between the lobe tops and the barrel wall, which lines travel in the direction of the arrow C as the rotors rotate. The shaded area A represents a working chamber just after it has been cut off from the inlet port 8 and the shaded area B a working chamber that has started to open towards the outlet port 9. As can be seen the volume of each chamber increases during the filling phase when the chamber communicates with the inlet port 8 and thereafter decreases.

Figure 4:
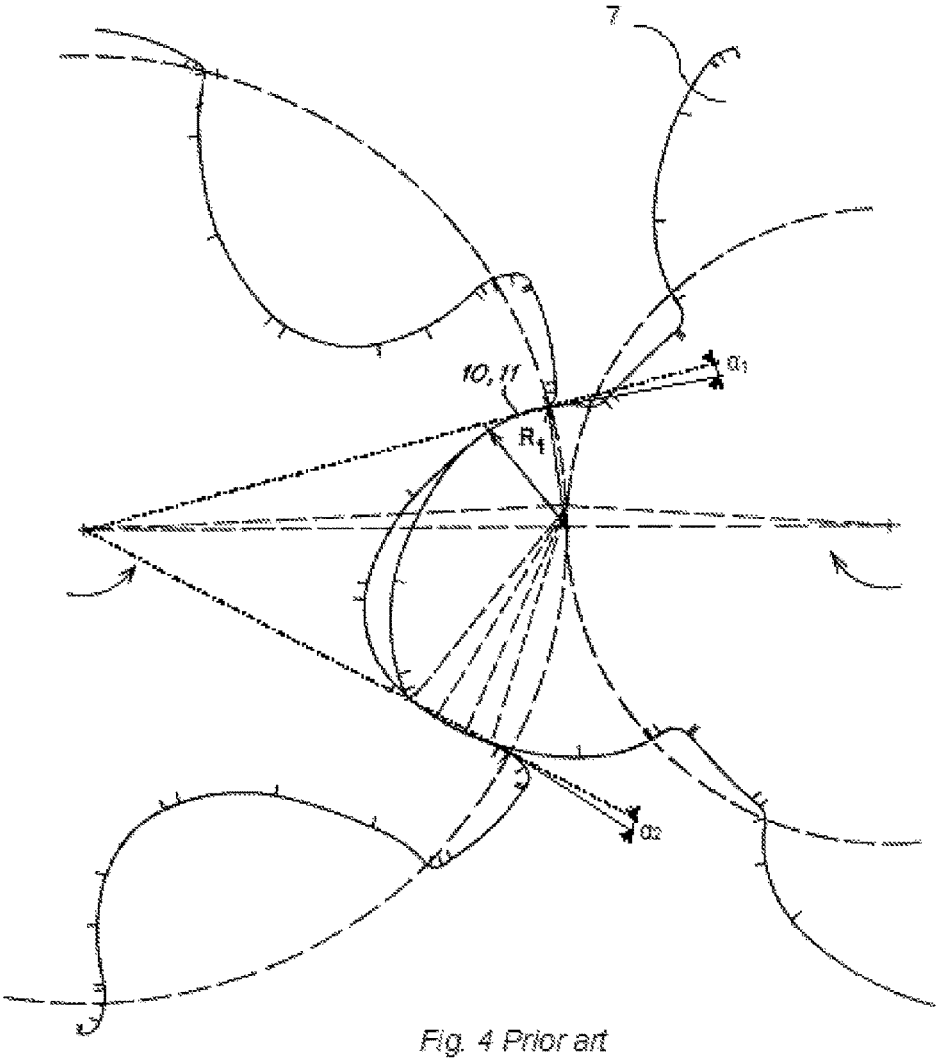
Fig. 4 Prior art
FIG. 4 shows a pair of screw rotors of the known G-profile type.

In FIG. 4 a pair of screw rotors of the known G-profile type is shown. The rotors rotate as indicated by the arrows, the male rotor being the driving rotor. The leading flank of the male rotor lobe has a profile segment 11 being a circular arc. On the trailing flank of the female rotor lobe, i.e. the leading flank of the female rotor groove, there is a corresponding circular arc flank segment 10 co-operating with the circular arc flank segment 11 of the male rotor lobe 7 so that a contact band is created through which torque is transmitted from the male rotor 1 to the female rotor 2. In FIG. 4 the mesh position, when the circular arc segments 10, 11 contact each other, is shown for male drive. As can be seen in the figure, the tangent of the leading flank of the female rotor groove at the pitch circle forms a very small angle $\alpha_1$ with a radial line drawn through the center of the rotor. The corresponding angle $\alpha_2$ of the trailing flank of the groove is also very small. Thus, the profile has a closed character, making it difficult to manufacture in manufacturing tools, requiring substantially parallel edges of the cutting tool at the outer portion thereof. Such a shape of the cutter induces a high wear thereof, and a high amount of tool material has to be ground away during each re-sharpening. Since the number of possible re-sharpenings is limited, tools costs will be a significant part of the final cost of the rotor.

Figure 5:
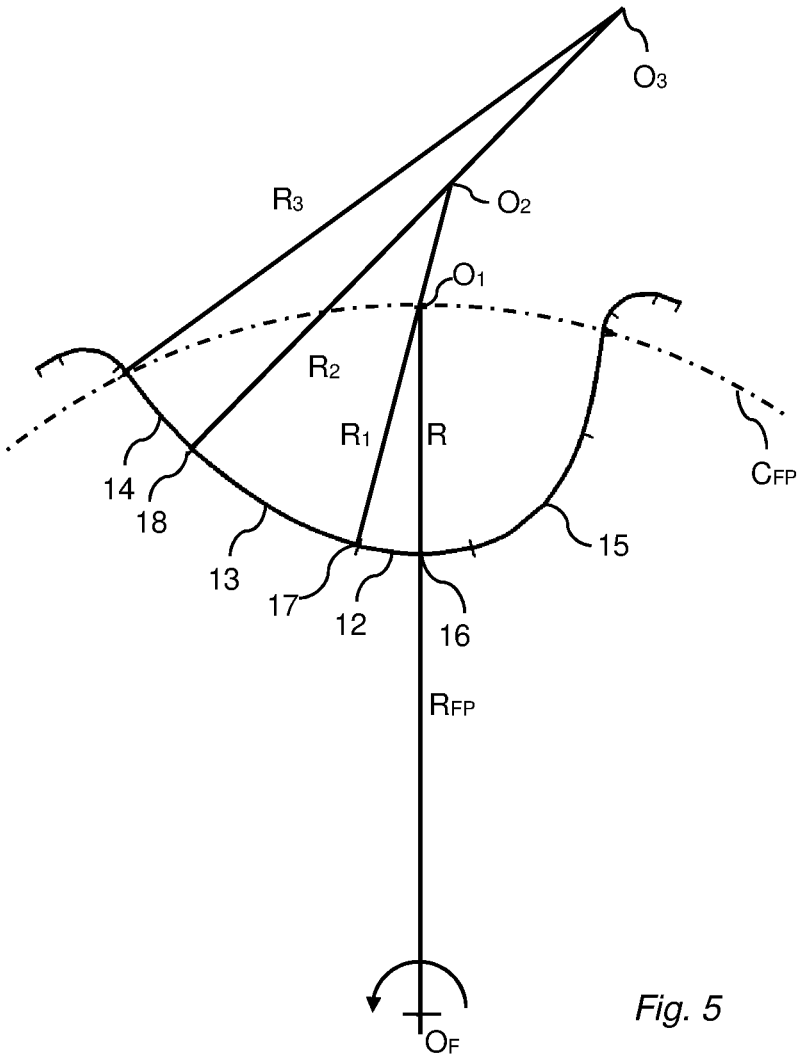
FIG. 5 shows a portion of a female rotor of an embodiment of a pair of screw rotors according to the invention.

FIG. 5 shows a portion of a female rotor of an embodiment of a pair of screw rotors according to the invention. The female rotor rotates as indicated by the arrow, being driven by a male rotor (not shown). In the figure, two helically extending lobes and an intermediate groove is shown. The female rotor has a pitch radius $R_{FP}$ defining a pitch circle $C_{FP}$ relative a center $O_F$ of the female rotor. The illustrated groove has a first or leading flank comprising at least three concave sections 12, 13, 14. The sections 12, 13, 14 are formed immediately adjacent to each other and consecutively. A first section 12 comprises the radially innermost point 16 of the groove. The first section is shaped as a circular arc with a radius $R_1$ having its center $O_1$ located on the pitch circle. $R_1$ equals the radial distance R between the pitch circle and the radially innermost point of the groove. The center $O_1$ is defined by the crossing of the pitch circle and a straight line traversing the center of the rotor and the radially innermost point 16 of the groove. A second section 13 is shaped as a circular arc with a radius $R_2$ having its center $O_2$ located outside the pitch circle. The center $O_2$ is located on a straight line extending from the end point 17 of the first section through $O_1$, at a distance $R_2$ from the groove. The straight line extending between the end point 17 and $O_1$ may also be described as the limiting line of the first section. A third section 14 is shaped as a circular arc with a radius $R_3$ having its center $O_3$ located outside the pitch circle. The center $O_3$ is located on a straight line extending from the end point 18 of the second section through $O_2$, at a distance $R_3$ from the groove. The straight line extending between the end point 18 and $O_2$ may also be described as the limiting line of the second section. As can be seen in the figure, the radius of the third section is greater than the radius of the second section, which is greater than the radius of the first section. Advantageously, the radius of the second section is 1.25 to 1.75 times the radius of the first section, and the radius of the third section is 2 to 3 times the radius of the first section. The illustrated groove also has a second flank opposite the first flank which comprises a convex section 15. The section 15 may be generated by a corresponding section of the male rotor.

Figure 6:
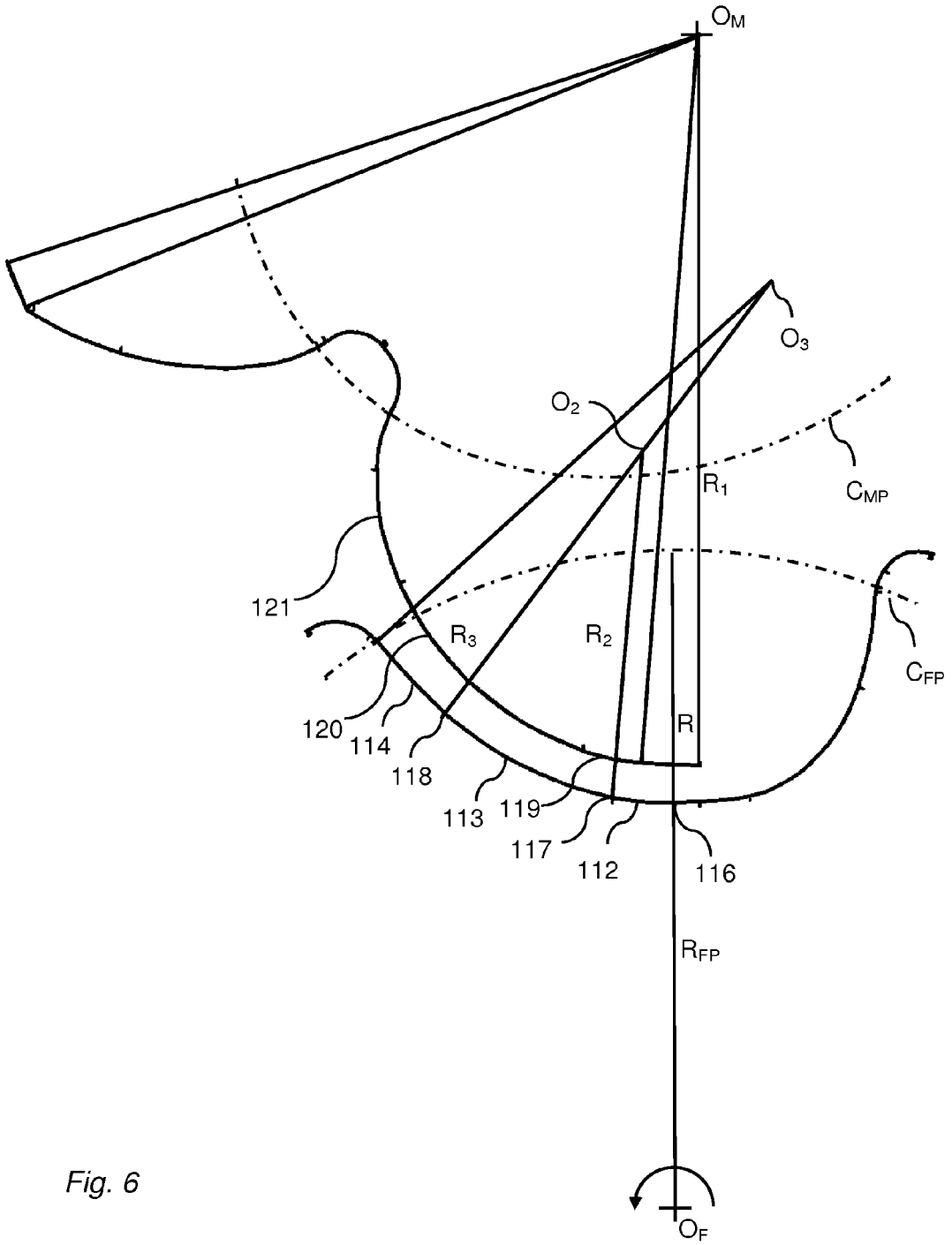
FIG. 6 shows portions of a female and a male rotor of another embodiment of a pair of screw rotors according to the invention.

FIG. 6 shows portions of a male and a female rotor of another embodiment of a pair of screw rotors according to the invention. In the figure, a portion of a female rotor with two helically extending lobes and an intermediate groove, and a portion of a male rotor with two helically extending lobes and an intermediate groove are shown. The male and female rotors are illustrated at a distance from each other, it is however understood that in use, the two rotors are essentially in contact with each other at least at one point, i.e. has a very tight play to avoid leakage. The rotors rotate as indicated by the arrow, the male rotor being the driving rotor.

The female rotor has a pitch radius $R_{FP}$ defining a pitch circle $C_{FP}$. The illustrated groove has a first or leading flank comprising at least three concave sections 112, 113, 114. The sections 112, 113, 114 are formed immediately adjacent to each other and consecutively. A first section 112 comprises the radially innermost point 116 of the groove. A second section 113 is shaped as a circular arc with a radius $R_2$ having its center $O_2$ located outside the pitch circle. The center $O_2$ is located on a straight line extending from the end point 117 of the first section along the normal direction of the first section, at a distance $R_2$ from the groove. A third section 114 is shaped as a circular arc with a radius $R_3$ having its center $O_3$ located outside the pitch circle. The center $O_3$ is located on a straight line extending from the end point 118 of the second section through $O_2$, at a distance $R_3$ from the groove. As can be seen in the figure, the radius of the third section is greater than the radius of the second section, which is greater than the radial distance R between the pitch circle and the radially innermost point 116 of said groove. Advantageously, $R_2$ is 1.25 to 1.75 times R, and $R_3$ is 2 to 3 times R.

FIG. 6 also shows a first or leading flank of a lobe of the male rotor, which first or leading flank comprises at least three essentially convex sections 119, 120, 121. The sections 119, 120, 121 are formed immediately adjacent to each other and consecutively. A first section 119 is shaped as a circular arc with a radius $R_1$ having its center coinciding with the center $O_M$ of the male rotor, thus inside of the pitch circle $C_{MP}$ of the male rotor. The first section 112 of the female rotor is generated by the first section 119 of the male rotor, i.e. is the envelope of the first section of the male rotor, while the second and third sections 120, 121 of the male rotor are generated by the second and third section 113, 144 of the female rotor, respectively.

Although exemplary embodiments of the present invention have been shown and described, it will be apparent to the person skilled in the art that a number of changes and modifications may be made. It is understood that the above description of the invention and the drawings are to be regarded as non-limiting examples thereof and that the scope of the invention is defined by the patent claims.

The invention claimed is:

1. A pair of co-operating screw rotors, comprising:

a male rotor having helically extending lobes and intermediate grooves; and a female rotor having:

helically extending lobes and intermediate grooves which are configured to intermesh with the helically extending lobes and intermediate grooves of said male rotor;

a pitch radius ($R_{FP}$) defining a pitch circle ($C_{FP}$), each groove of the female rotor having a first flank comprising at least three concave sections including:

a first section comprising a radially innermost point of said groove;

a second section shaped as a circular arc with a radius (R2) having its center located outside the pitch circle; and a third section is shaped as a circular arc with a radius (R3) having its center located outside the pitch circle, said radius (R3) of the third section being greater than said radius (R2) of the second section which is greater than a radial distance (R) between the pitch circle and said radially innermost point of said groove.

2. The pair of co-operating screw rotors according to claim 1, wherein said first section is shaped as a circular arc with a radius (R1) having its center located on the pitch circle.

3. The pair of co-operating screw rotors according to claim 2, wherein the radius (R2) of the circular arc of the second section has its center located on a straight line extending radially from an end point of said first section along the normal direction of said first section.

4. The pair of co-operating screw rotors according to claim 3, wherein said radius of said first section corresponds to the radial distance between the pitch circle and said radially innermost point of said groove.

5. The pair of co-operating screw rotors according to claim 2, wherein each lobe of the male rotor has a first lobe flank comprising a convex section which is generated at least partly by said at least three concave sections of said female rotor.

6. The pair of co-operating screw rotors according to claim 2, wherein said center of said first section is defined by the crossing of the pitch circle and a straight line traversing the center of the female rotor and the radially innermost point of said groove.

7. The pair of co-operating screw rotors according to claim 2, wherein said radius (R2) of the second section is 1.25 to 1.75 times the radial distance (R) between the pitch circle and said radially innermost point of said groove, and wherein said radius (R3) of the third section is 2 to 3 times the radial distance (R) between the pitch circle and said radially innermost point of said groove.

8. The pair of co-operating screw rotors according to claim 1, wherein each lobe of the male rotor has a first lobe flank comprising a convex section which is shaped as a circular arc with a radius having its center located on or inside a pitch circle of the male rotor, and wherein said first section of said female rotor is generated by said convex section of said male rotor.

9. The pair of co-operating screw rotors according to claim 8, wherein the radius (R2) of the circular arc of the second section has its center located on a straight line extending radially from an end point of said first section along the normal direction of said first section.

10. The pair of co-operating screw rotors according to claim 8, wherein said radius (R2) of the second section is 1.25 to 1.75 times the radial distance (R) between the pitch circle and said radially innermost point of said groove, and wherein said radius (R3) of the third section is 2 to 3 times the radial distance (R) between the pitch circle and said radially innermost point of said groove.

11. The pair of co-operating screw rotors according to claim 10, wherein each groove of the female rotor has a second flank comprising a concave section, each lobe of the male rotor has a second lobe flank comprising a convex section which is generated by said concave section of said female rotor.

12. The pair of co-operating screw rotors according to claim 8, wherein each groove of the female rotor has a second flank comprising a concave section, each lobe of the male rotor has a second lobe flank comprising a convex section which is generated by said concave section of said female rotor.

13. The pair of co-operating screw rotors according to claim 1, wherein the radius (R2) of the circular arc of the second section has its center located on a straight line extending radially from an end point of said first section along the normal direction of said first section.

14. The pair of co-operating screw rotors according to claim 13, wherein each groove of the female rotor has a second flank comprising a concave section, each lobe of the male rotor has a second lobe flank comprising a convex section which is generated by said concave section of said female rotor.

15. The pair of co-operating screw rotors according to claim 1, wherein the radius (R3) of the circular arc of the third section has its center located on a straight line extending radially from an end point of said second section along the normal direction of said second section.

16. A pair of co-operating screw rotors according to claim 1, wherein said first, second and third sections are formed immediately adjacent to each other.

17. The pair of co-operating screw rotors according to claim 1, wherein said first, second and third sections are consecutively disposed.

18. The pair of co-operating screw rotors according to claim 1, wherein said radius (R2) of the second section is 1.25 to 1.75 times the radial distance (R) between the pitch circle and said radially innermost point of said groove, and wherein said radius (R3) of the third section is 2 to 3 times the radial distance (R) between the pitch circle and said radially innermost point of said groove.

19. The pair of co-operating screw rotors according to claim 1, wherein each lobe of the male rotor has a first lobe flank comprising a convex section which is generated at least partly by said second and third sections of said female rotor.

20. The pair of co-operating screw rotors according to claim 1, wherein each groove of the female rotor has a second flank comprising a concave section, each lobe of the male rotor has a second lobe flank comprising a convex section which is generated by said concave section of said female rotor.

* * * * *